US008831475B2

(12) United States Patent
Im et al.

(10) Patent No.: US 8,831,475 B2
(45) Date of Patent: Sep. 9, 2014

(54) IMAGE FORMING APPARATUS

(71) Applicant: Samsung Electronics Co., Ltd., Suwon-si (KR)

(72) Inventors: Dae Hyeok Im, Suwon-si (KR); Byung Sun Ahn, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 120 days.

(21) Appl. No.: 13/657,212

(22) Filed: Oct. 22, 2012

(65) Prior Publication Data

US 2013/0129382 A1 May 23, 2013

(30) Foreign Application Priority Data

Nov. 22, 2011 (KR) ..... 10-2011-0121968

(51) Int. Cl.
*G03G 21/18* (2006.01)

(52) U.S. Cl.
CPC ..... *G03G 21/1853* (2013.01)
USPC ..... 399/111

(58) Field of Classification Search
CPC ..... G03G 21/16; G03G 21/1853; G03G 2221/1654
USPC ..... 399/110, 111, 119
See application file for complete search history.

(56) References Cited

U.S. PATENT DOCUMENTS

| | | | | |
|---|---|---|---|---|
| 2010/0080624 | A1* | 4/2010 | Matsuda | 399/119 |
| 2010/0247138 | A1* | 9/2010 | Kikuchi et al. | 399/110 |
| 2012/0070186 | A1* | 3/2012 | Kikuchi et al. | 399/110 |

* cited by examiner

*Primary Examiner* — Walter L Lindsay, Jr.
*Assistant Examiner* — Rodney Bonnette
(74) *Attorney, Agent, or Firm* — Staas & Halsey LLP

(57) ABSTRACT

An image forming apparatus capable of easily achieving installation of developing units on a developing tray is disclosed. The disclosed image forming apparatus includes a tray section, a plurality of developing units each provided with guide protrusions, and a developing tray including a plurality of supports to support the guide protrusions of the developing units, and a plurality of guides each adapted to guide a corresponding one of the guide protrusions to a corresponding one of the supports. The guides have widths gradually increasing in a direction from a first end of the tray section to a second end of the tray section, respectively.

18 Claims, 11 Drawing Sheets

IMAGE FORMING APPARATUS

CROSS-REFERENCE TO RELATED APPLICATIONS

This application claims the priority benefit of Korean Patent Application No. 10-2011-0121968, filed on Nov. 22, 2011 in the Korean Intellectual Property Office, the disclosure of which is incorporated herein by reference.

BACKGROUND

1. Field

Embodiments relate to an image forming apparatus equipped with a development tray movably installed on a body and provided with a development unit.

2. Description of the Related Art

Generally, an image forming apparatus forms an image on a printing medium. Examples of such an image forming apparatus include a printer, a copy machine, a facsimile machine, and a complex machine having the functions of the above-mentioned appliances.

Such an image forming apparatus includes a body provided, at one side thereof, with an opening, a plurality of developing units each adapted to develop an electrostatic latent image into a visible image, using a corresponding one of developing agents of different colors, an exposure device to scan light onto photosensitive bodies of the development units, and thus to form an electrostatic latent image on the photosensitive body of each development unit, a transfer device to transfer the visible image developed using the corresponding developing agent to a printing medium, and a fusing device to fuse the developing agents of the visible image to the printing medium.

Of image forming apparatuses having the above-mentioned configuration, there is an image forming apparatus in which a plurality of developing units are installed in a developing tray movably installed in an opening formed through one side of a body, to easily and conveniently replace the developing units, the developing agents of which have been consumed.

SUMMARY

In accordance with an aspect of one or more embodiments, there is provided an image forming apparatus capable of more easily achieving installation of developing units on a developing tray.

In accordance with an aspect of one or more embodiments, there is provided an image forming apparatus includes a body provided with an opening at one side thereof, a developing tray movably installed at the opening, and a plurality of developing units mounted to the developing tray, wherein each of the developing units includes guide protrusions provided at opposite sides of the developing unit, respectively, to guide mounting of the developing unit to the developing tray, wherein the developing tray includes a tray section, to which the developing units are mounted, a plurality of supports provided at opposite inner side surfaces of the tray section, to support associated ones of the guide protrusions, and a plurality of guides each adapted to guide a corresponding one of the plural guide protrusions to a corresponding one of the plural supports, wherein the tray section includes a first end protruded from the body through the opening, and a second end provided opposite to the first end such that the second end extends into an interior of the body, and wherein the guides have widths gradually increasing in a direction from the first end to the second end, respectively.

The guide, which is disposed at a side of the first end, may have a width equal to a width of the corresponding support.

Each of the guides may include a first guide surface and a second guide surface, which face each other while being spaced apart from each other in the direction from the first end to the second end.

Each of the first and second guide surfaces may include a curved portion extending from an upper end of the corresponding support in the form of a curved line, and a straight portion upwardly extending from the curved portion such that the straight portions of the first and second guide surfaces extend in parallel to define a gap corresponding to a width of the guide therebetween.

The straight portion gaps of the guides may be gradually increased in the direction from the first end to the second end.

The first guide surface may upwardly incline and extend toward the first end. The second guide surface may upwardly incline and extend toward the second end.

Angles formed by the first guide surfaces of the guides with respect to a horizontal plane may be gradually decreased in the direction from the first end to the second end. Angles formed by the second guide surfaces of the guides with respect to the horizontal plane may be gradually decreased in the direction from the first end to the second end.

The first guide surface may upwardly incline and extend toward the first end, and the second guide surface may vertically extend.

Angles formed by the first guide surfaces of the guides with respect to a horizontal plane may be gradually decreased in the direction from the first end to the second end.

Heights of upper ends of the first guide surfaces in the guides may be gradually decreased in the direction from the first end to the second end.

The first guide surface may upwardly inclined and extend toward the first end, and the second guide surface may upwardly extend in the form of a straight line.

Angles formed by the first guide surfaces of the guides with respect to a horizontal plane may be gradually decreased in the direction from the first end to the second end.

One of the plural developing units may be a developing unit containing a black developing agent. The developing unit containing the black developing agent may be mounted adjacent to one of the first and second ends of the tray section.

The developing unit containing the black developing agent may include a guide protrusion having a larger diameter than the protrusions of the remaining developing units. One of the plural supports, which supports the guide protrusion of the developing unit containing the black developing agent, may have a larger width than the remaining supports such that the width corresponds to the diameter of the guide protrusion of the developing unit containing the black developing agent.

The developing unit containing the black developing agent may include a pair of guide protrusions. One of the plural supports, which supports the guide protrusion of the developing unit containing the black developing agent, may include a pair of supports to support the pair of guide protrusions. One of the plural guides, which guides the guide protrusion of the developing unit containing the black developing agent, may include a pair of guides to guide the pair of guide protrusions to the pair of supports.

In accordance with an aspect of one or more embodiments, there is provided an image forming apparatus includes a body provided with an opening at one side thereof, a developing tray movably installed at the opening, and a plurality of developing units mounted to the developing tray, wherein each of the developing units includes guide protrusions provided at opposite sides of the developing unit, respectively, to guide mounting of the developing unit to the developing tray, wherein the developing tray includes a tray section, to which the developing units are mounted, a plurality of supports provided at opposite inner side surfaces of the tray section, to support associated ones of the guide protrusions, and a plurality of guides each adapted to guide a corresponding one of the plural guide protrusions to a corresponding one of the plural supports, wherein the tray section includes a first end protruded from the body through the opening, and a second end provided opposite to the first end such that the second end extends into an interior of the body, and wherein one of the guides, which is disposed nearest the second end, has a larger width than the remaining guides.

In accordance with an aspect of one or more embodiments, there is provided an image forming apparatus includes a body provided with an opening at one side thereof, a developing tray movably installed at the opening, and a plurality of developing units mounted to the developing tray, wherein each of the developing units includes guide protrusions provided at opposite sides of the developing unit, respectively, to guide mounting of the developing unit to the developing tray, wherein the developing tray includes a tray section, to which the developing units are mounted, a plurality of supports provided at opposite inner side surfaces of the tray section, to support associated ones of the guide protrusions, and a plurality of guides each adapted to guide a corresponding one of the plural guide protrusions to a corresponding one of the plural supports, wherein the tray section includes a first end protruded from the body through the opening, and a second end provided opposite to the first end such that the second end extends into an interior of the body, and wherein at least one of the plural guides, which is disposed adjacent the second end, has a larger width than at least one of the remaining guides, which is disposed adjacent the first end.

In accordance with an aspect of one or more embodiments, there is provided an image forming apparatus including a body provided with an opening at one side thereof; a developing tray movably installed into the opening; and a plurality of developing units mounted to the developing tray, wherein each of the developing units comprises guide protrusions provided at opposite sides of the developing unit, respectively, to guide mounting of the developing units to the developing tray, wherein the developing tray comprises a tray section, to which the developing units are mounted, a plurality of supports provided at opposite inner side surfaces of the tray section, to support the guide protrusions, and a plurality of guides each adapted to guide a corresponding one of the guide protrusions to a corresponding one of the supports, wherein the tray section comprises a first end protruded from the body through the opening, and a second end provided opposite to the first end such that the second end extends into an interior of the body, wherein each guide has a first guide surface forming a guide angle with respect to a horizontal plane, and each formed guide angle is different from the other formed angles, and wherein each guide angle decreases in a direction from the first end of the tray section to the second end of the tray section.

BRIEF DESCRIPTION OF THE DRAWINGS

These and/or other aspects will become apparent and more readily appreciated from the following description of embodiments, taken in conjunction with the accompanying drawings of which.

DETAILED DESCRIPTION

Hereinafter, an image forming apparatus according to embodiments will be described in detail with reference to the accompanying drawings.

Figure 1:
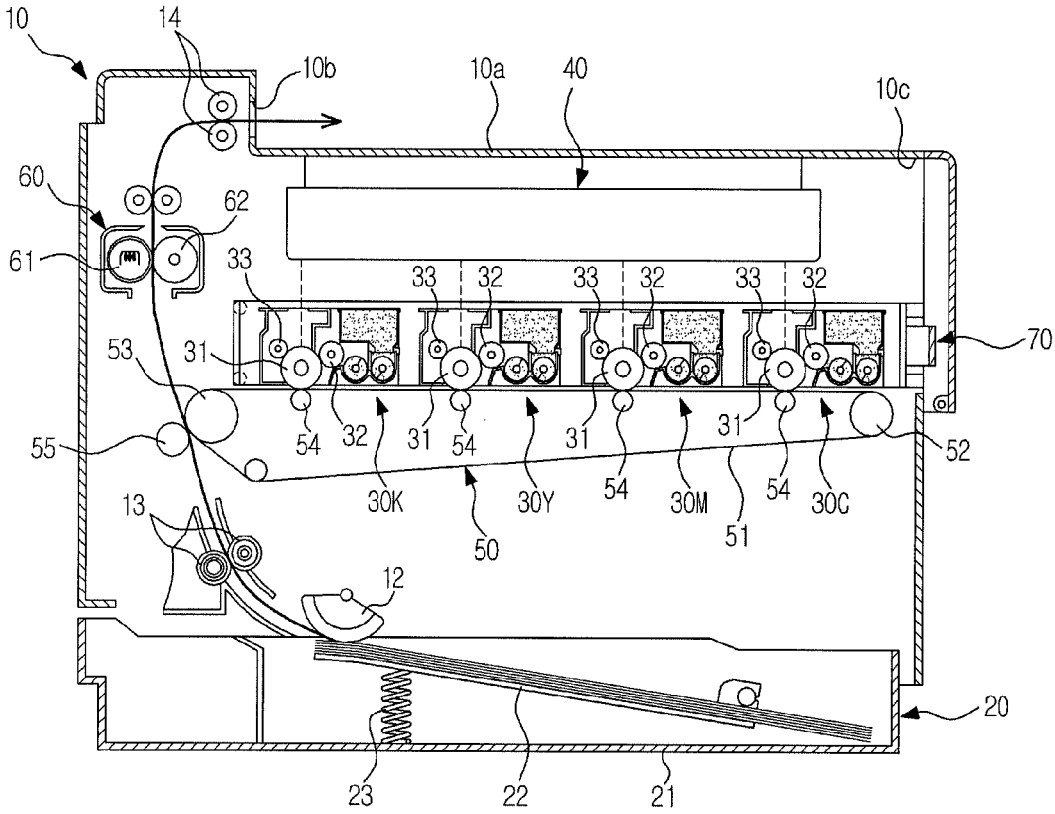
FIG. 1 is a schematic view illustrating an image forming apparatus according to an embodiment.

As shown in FIG. 1, the image forming apparatus according to an embodiment includes a body 10 to define an outer appearance of the apparatus, a printing medium storage unit 20 to store printing mediums therein, a plurality of developing units 30C, 30M, 30Y and 30K each adapted to develop a latent image into a visible image using a corresponding one of developing agents of different colors, and an exposure unit 40 to scan light onto photosensitive bodies 31 of the developing units 30C, 30M, 30Y and 30K in a charged state, and thus to form a latent image on each photosensitive body 31. The image forming apparatus also includes a transfer unit 50 to receive one printing medium from the printing medium storage unit 20, and to transfer a visible image formed on each photosensitive body 31 to the printing medium, and a fusing unit 60 to fuse, to the printing medium, the developing agent of the visible image transferred to the printing medium.

The body 10 is provided, at a top thereof, with a stacking section 10*a*, on which printing mediums having completed image formation are stacked. The body 10 is also provided, at one side of the stacking section 10*a*, with a discharge port 10*b*, through which printing mediums completing image formation are discharged.

The printing medium storage unit 20 includes a printing medium cassette 21 movably mounted to the body 10, a knock-up plate 22 disposed in the printing medium cassette 21, to stack printing mediums thereon, and an elastic member 23 to elastically support the knock-up plate 22.

Each of the developing units 30C, 30M, 30Y and 30K includes one photosensitive body 31. On a charged surface of the photosensitive body 31, a latent image is formed by the exposure unit 40. Each of the developing units 30C, 30M, 30Y and 30K also includes a developing roller 32 to supply the corresponding developing agent to the photosensitive body 31, and a charging unit 33 to charge the surface of the photosensitive body 31.

Each of the developing units 30C, 30M, 30Y and 30K stores a corresponding one of the developing agents, the color of which may be one of cyan (C), magenta (M), yellow (Y) and black (K). That is, there are four developing units, namely, developing units 30C, 30M, 30Y and 30K, which may develop different colors, namely, cyan (C), magenta (M), yellow (Y) and black (K), respectively. The four developing units 30C, 30M, 30Y and 30K are disposed in parallel beneath the transfer unit 50.

The exposure unit 40 irradiates light carrying image information onto the photosensitive bodies 31 provided at respective developing units 30C, 30M, 30Y and 30K, to form a latent image on the surface of each photosensitive body 31.

The transfer unit 50 includes a transfer belt 51, to which the developing agents used to develop latent images on respective photosensitive bodies 31 of the developing units 30C, 30M, 30Y and 30K are transferred in an overlapping manner, and a drive roller 52 and a driven roller 53, which are disposed inside the transfer belt 51 at opposite sides of the transfer unit 50, respectively, to rotate the transfer belt 51. The transfer unit 50 also includes a plurality of first transfer rollers 54 disposed to face respective photosensitive bodies 31 of the developing units 30C, 30M, 30Y and 30K such that the transfer belt 51 is interposed between each first transfer roller 54 and the corresponding photosensitive body 31, to transfer visible images formed on respective photosensitive bodies 31 to the transfer belt 51, and a second transfer roller 55 disposed to face the driven roller 53 such that the transfer belt 51 is interposed between the second transfer roller 55 and the driven roller 53, to transfer the visible images on the transfer belt 51 to the printing medium fed to the second transfer roller 55.

The fusing unit 60 includes a heating roller 61 to generate heat, and a pressing roller 62 having an outer circumferential surface made of an elastically deformable material, to press the printing medium fed to the heating roller 61 onto an outer circumferential surface of the heating roller 61.

The body 10 is also provided with a pick-up roller 12 disposed over the printing medium storage unit 20, to pick up, one sheet by one sheet, the printing mediums stacked on the knock-up plate 22, a feeding roller 13 to upwardly guide the printing medium picked up by the pick-up roller 12, and a discharge roller 14 disposed over the fusing unit 60 adjacent to the discharge port 10*b*, to discharge the printing medium emerging from the fusing unit 60 through the discharge port 10*b*.

In the image forming apparatus having the above-described configuration, the developing units 30C, 30M, 30Y and 30K, which contain the developing agents, should be replaced after the developing agents are completely consumed.

Figure 2:
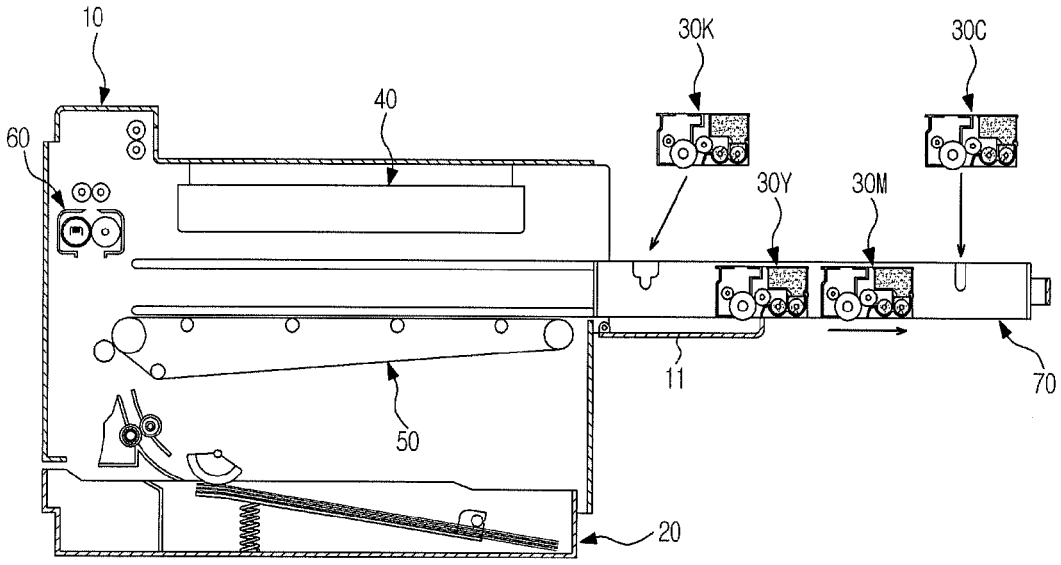
FIGS. 2 and 3 are schematic views illustrating mounting of developing units according to an embodiment.
Figure 3:
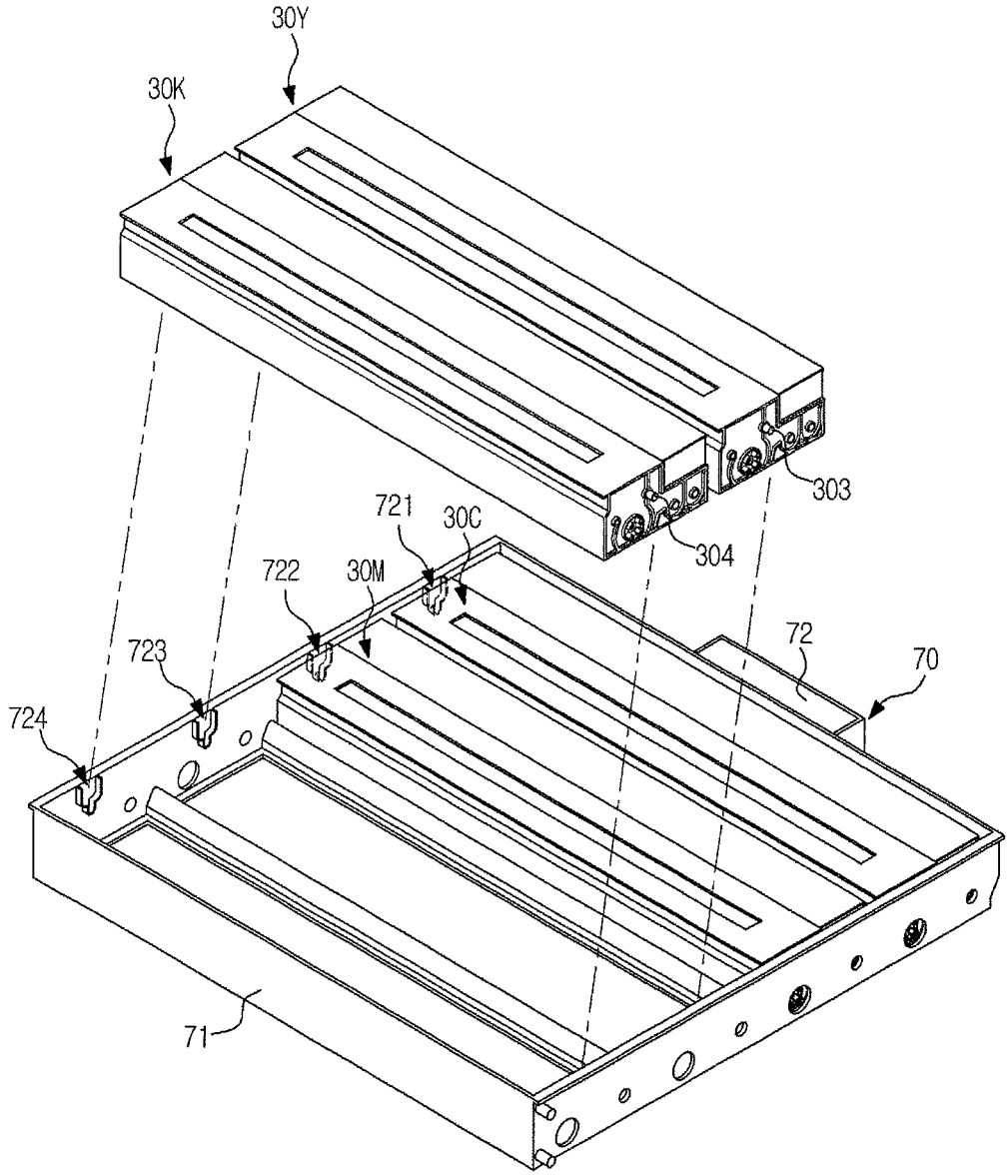

For replacement of the developing units 30C, 30M, 30Y and 30K, an opening 10*c* is provided at one side of the body 10. At the opening 10*c*, a cover 11 is arranged. The cover 11 is pivotally mounted to the body 10, to open or close the opening 10*c*. As shown in FIGS. 2 and 3, a developing tray 70 is movably installed at the opening 10*c*, for installation of the developing units 30C, 30M, 30Y and 30K. The developing tray 70 includes a tray section 71, to which the developing units 30C, 30M, 30Y and 30K are mounted, and a handle 72 to enable the user to apply force to the developing tray 70. The tray section 71 has a first end protruded from the body 10 through the opening 10*c*. At the first end of the tray section 71, the handle 81 is provided. The tray section 71 also has a second end disposed opposite to the first end. The second end of the tray section 71 extends into the interior of the body 10.

When it is necessary to replace the developing units 30C, 30M, 30Y and 30K due to complete consumption of developing agents, the cover 11 is opened, and then the developing tray 70 is moved using the handle 72 such that the first end of the tray section 71 of the developing tray 70 is extracted from the body 10 through the opening 10*c*. In this state, the developing units 30C, 30M, 30Y and 30K to be replaced are separated from the developing tray 70. Thereafter, new developing units 30C, 30M, 30Y and 30K are mounted to the developing tray 70. After mounting of the new developing units 30C, 30M, 30Y and 30K, the developing tray 70 is moved such that the tray section 71 is received in the body 10. The opening 10*c* is then closed by the cover 11. Thus, replacement of the developing units 30C, 30M, 30Y and 30K is completed.

Figure 4:
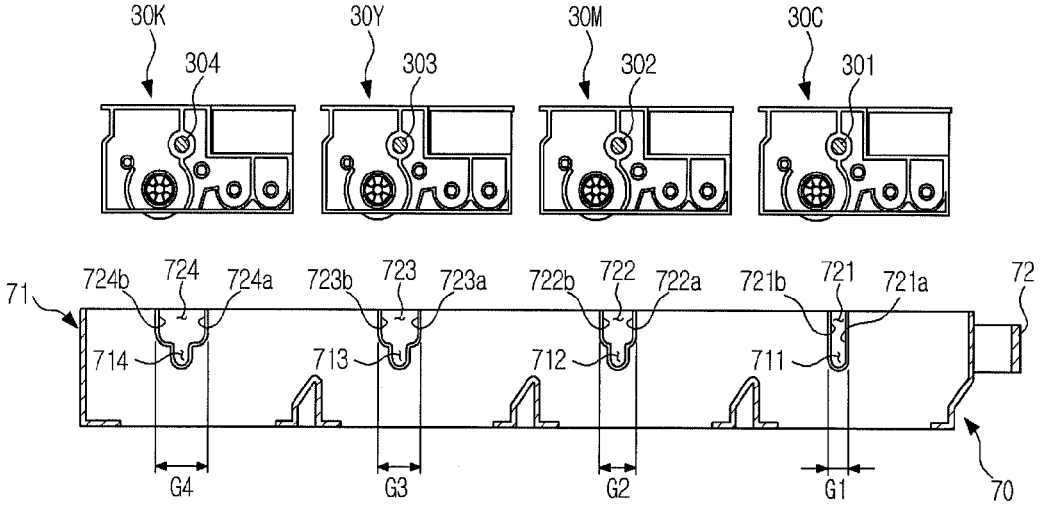
FIG. 4 is a schematic view illustrating the developing units and a developing tray, which are configured in accordance with an embodiment.

The developing units 30C, 30M, 30Y and 30K are installed at predetermined positions in the tray section 71, respectively. In order to guide installation of the developing units 30C, 30M, 30Y and 30K at predetermined respective positions thereof, guide protrusions 301, 302, 303 and 304 are provided at the developing units 30C, 30M, 30Y and 30K, respectively, such that the guide protrusions 301, 302, 303 or 304 of each developing units 30C, 30M, 30Y or 30K are disposed at opposite sides of the developing units 30C, 30M, 30Y or 30K, as shown in FIG. 4. Also, the tray section 71 is provided, at opposite inner side surfaces thereof, with supports 711, 712, 713 and 714 to provide seats for the guide protrusions 301, 302, 303 and 304, and thus to support the guide protrusions 301, 302, 303 and 304, respectively, and guides 721, 722, 723 and 724 to guide the guide protrusions 301, 302, 303 and 304 to the supports 711, 712, 713 and 714, respectively. In the illustrated embodiment, four supports, namely, the supports 711, 712, 713 and 714, and four guides, namely, the guides 721, 722, 723 and 724, are provided because four developing units, namely, the developing units 30C, 30M, 30Y and 30K, are provided as described above.

Each of the guide protrusions 301, 302, 303 and 304 is formed to have a circular cross-section. Each of the supports 711, 712, 713 and 714 is formed to have a semicircular curved surface at a lower end thereof such that the semicircular curved surface corresponds to a corresponding one of the guide protrusions 301, 302, 303 and 304. Each guide 721, 722, 723 or 724 has a first guide surface 721 a, 722*a*, 723*a* or 724*a* and a second guide surface 721*b*, 722*b*, 723*b* or 724*b*, which face each other while being spaced apart from each other in a direction from the first end to the second end.

Since the developing tray 70 is configured to be extracted from the body 10 through the opening 10*c*, generally, the user conducts replacement of the developing units 30C, 30M, 30Y and 30K in front of the opening 10*c*. For this reason, the developing unit 30C, which is installed at the side of the first end of the tray section 71, may be easily mounted to the tray section 71, whereas it is relatively difficult to mount, to the tray section 71, the developing unit 30K, which is installed at the side of the second end of the tray section 71.

To this end, in order to achieve easy mounting of the developing units 30C, 30M, 30Y and 30K, even the developing unit to be installed at the side of the second end of the tray section 71, the widths of the guides 721, 722, 723 and 724 are gradually increased toward the second end of the tray section 71 such that the guide 721 disposed at the side of the first end of the tray section 71 has a smallest width, and the guide 724 disposed at the side of the second end of the tray section 71 has a greatest width.

When the guides 721, 722, 723 and 724 are configured to have widths gradually increasing toward the second end of the tray section 71, the innermost one of the developing units 30C, 30M, 30Y and 30K, which is to be installed at the side of the second end of the tray section 71, may be mounted not only in a vertical direction, but also in a downwardly inclined direction. Thus, all the developing units 30C, 30M, 30Y and 30K may be easily mounted.

Each of the first guide surface 721*a*, 722*a*, 723*a* or 724*a* and second guide surface 721*b*, 722*b*, 723*b* or 724*b* in each guide 721, 722, 723 or 724 includes a curved portion extending from an upper end of the corresponding support 711, 712, 713 or 714 in the form of a curved line, and a straight portion vertically extending from the curved portion. The straight portions of the first guide surface 721*a*, 722*a*, 723*a* or 724*a* and second guide surface 721*b*, 722*b*, 723*b* or 724*b* are parallel. The gap between the straight portions defines the width of the corresponding guide. The straight portion gaps in the guides 721, 722, 723 and 724 are gradually increased toward the second end of the tray section 71 such that the guide 721 disposed at the side of the first end of the tray section 71 has a smallest straight portion gap, and the guide 724 disposed at the side of the second end of the tray section 71 has a greatest straight portion gap. That is, a relation of G1<G2<G3<G4 is established. In the illustrated embodiment, the width of the guide 721 disposed at the side of the first end is equal to the width of the support 711.

Although each guide 721, 722, 723 or 724 includes the first guide surface 721*a*, 722*a*, 723*a* or 724*a* and second guide surface 721*b*, 722*b*, 723*b* or 724*b*, and each of the first guide surface 721*a*, 722*a*, 723*a* or 724*a* and second guide surface 721*b*, 722*b*, 723*b* or 724*b* includes a curved portion and a straight portion such that the gap between the straight portions of the first and second guide surfaces defines the width of the guide 721, 722, 723 or 724 in an above-described embodiment, embodiments are not limited thereto. For example, the widths of the guides may be adjusted in various embodiments.

Figure 5:
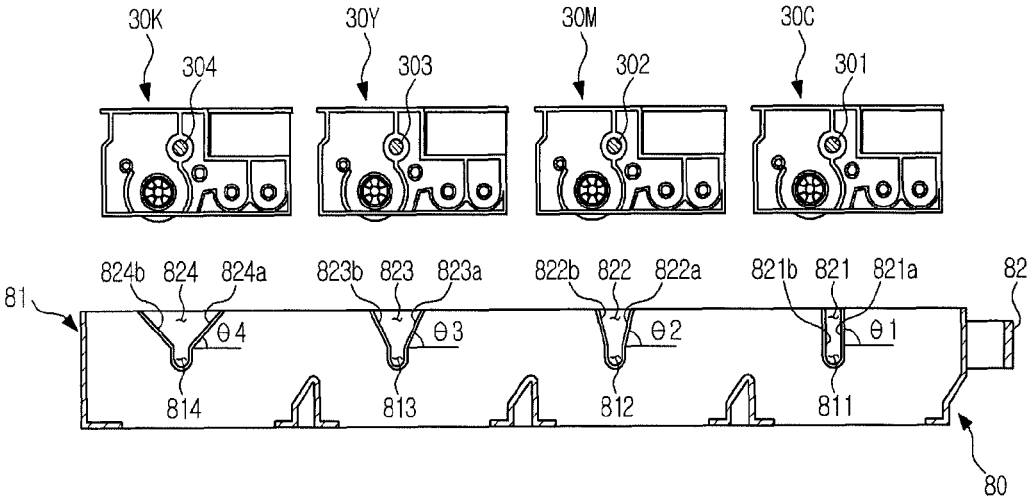
FIG. 5 is a schematic view illustrating developing units and a developing tray, which are configured in accordance with an embodiment.

FIG. 5 illustrates guides 821, 822, 823 and 824 according to an embodiment. As shown in FIG. 5, each guide 821, 822, 823 or 824 has a first guide surface 821*a*, 822*a*, 823*a* or 824*a* upwardly inclined and extending toward a first end of a tray section 81, at which a handle 82 is provided, and a second guide surface 821*b*, 822*b*, 823*b* or 824*b* upwardly inclined and extending toward a second end of the tray section 81 opposite to the first end. Each of the first guide surface 821*a*, 822*a*, 823*a* or 824*a* and second guide surface 821*b*, 822*b*, 823*b* or 824*b* forms a certain angle with respect to a horizontal plane. The angles of the guides 821, 822, 823 and 824 are gradually decreased toward the second end of the tray section 81 such that the guide 821 disposed at the side of the first end of the tray section 81 has a greatest angle, and the guide 824 disposed at the side of the second end of the tray section 81 has a smallest angle. That is, a relation of θ1>θ2>θ3>θ4 is established.

Figure 6:
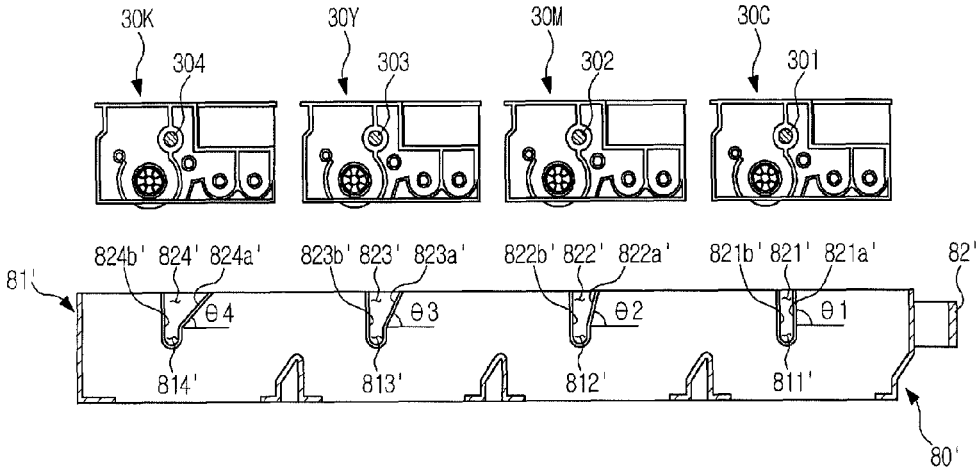
FIG. 6 is a schematic view illustrating developing units and a developing tray, which are configured in accordance with an embodiment.

FIG. 6 illustrates guides 821', 822', 823' and 824' according to an embodiment. As shown in FIG. 6, each guide 821', 822', 823' or 824' has a first guide surface 821*a*', 822*a*', 823*a*' or 824*a*' upwardly inclined and extending toward a first end of a tray section 81', at which a handle 82' is provided, and a vertically-extending second guide surface 821*b*', 822*b*', 823*b*' or 824*b*'. The first guide surface 821*a*', 822*a*', 823*a*' or 824*a*' forms a certain angle with respect to a horizontal plane. The angles of the guides 821', 822', 823' and 824' are gradually decreased toward the second end of the tray section 81' such that the guide 821' disposed at the side of the first end of the tray section 81' has a greatest angle, and the guide 824' disposed at the side of the second end of the tray section 81' has a smallest angle. That is, a relation of θ1>θ2>θ3>θ4 is established.

Figure 7:
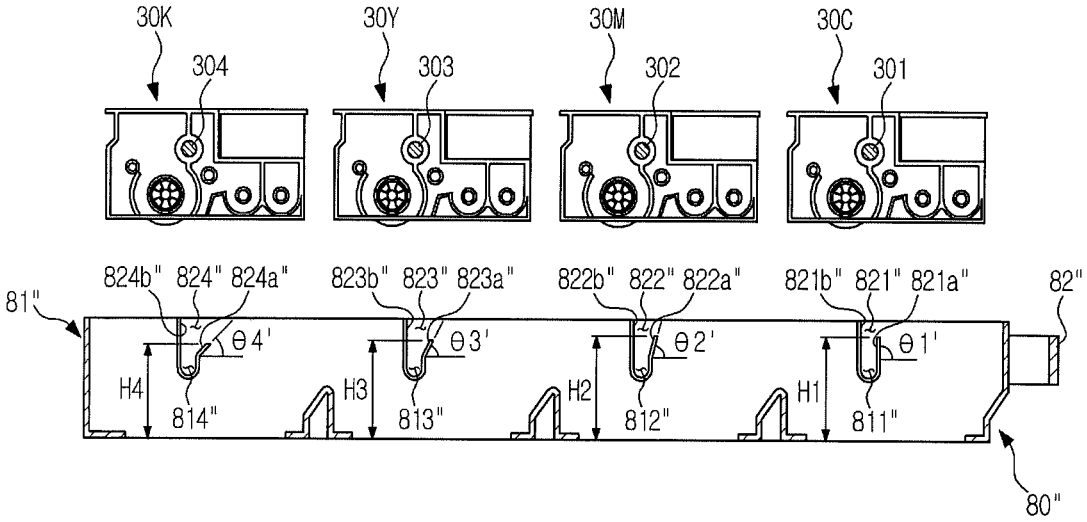
FIG. 7 is a schematic view illustrating developing units and a developing tray, which are configured in accordance with an embodiment.

FIG. 7 illustrates guides 821", 822", 823" and 824" according to an embodiment. As shown in FIG. 7, each guide 821", 822", 823" or 824" has a first guide surface 821*a*", 822*a*", 823*a*" or 824*a*" upwardly inclined and extending toward a first end of a tray section 81", at which a handle 82" is provided, and a vertically-extending second guide surface 821*b*", 822*b*", 823*b*" or 824*b*". The first guide surface 821*a*", 822*a*", 823*a*" or 824*a*" forms a certain angle with respect to a horizontal plane. The angles of the guides 821", 822", 823" and 824" are gradually decreased toward the second end of the tray section 81" such that the guide 821" disposed at the side of the first end of the tray section 81" has a greatest angle, and the guide 824" disposed at the side of the second end of the tray section 81" has a smallest angle. Also, the heights of upper ends of the first guide surfaces 821*a*", 822*a*", 823*a*" and 824*a*" in the guides 821", 822", 823" and 824" are gradually decreased toward the second end of the tray section 81" such that the first guide surface 821*a*" of the guide 821" disposed at the side of the first end of the tray section 81" has a greatest upper end height, and the first guide surface 824*a*" of the guide 824" disposed at the side of the second end of the tray section 81" has a smallest upper end height. That is, a relation that θ1>θ2>θ3>θ4 and a relation that H1>H2>H3>H4 are established.

Figure 8:
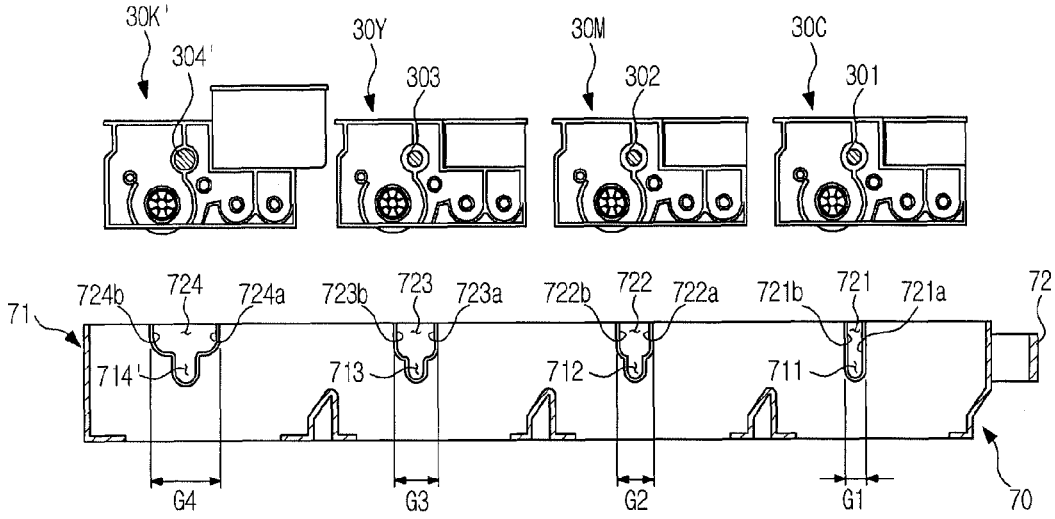
FIG. 8 is a schematic view illustrating developing units and a developing tray, which are configured in accordance with an embodiment.
Figure 9:
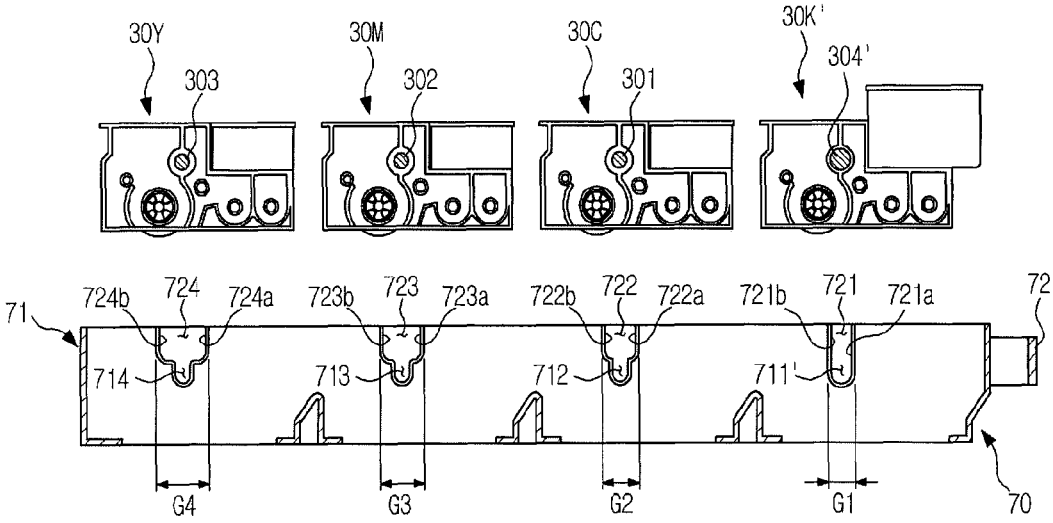
FIG. 9 is a schematic view illustrating developing units and a developing tray, which are configured in accordance with an embodiment.
Figure 10:
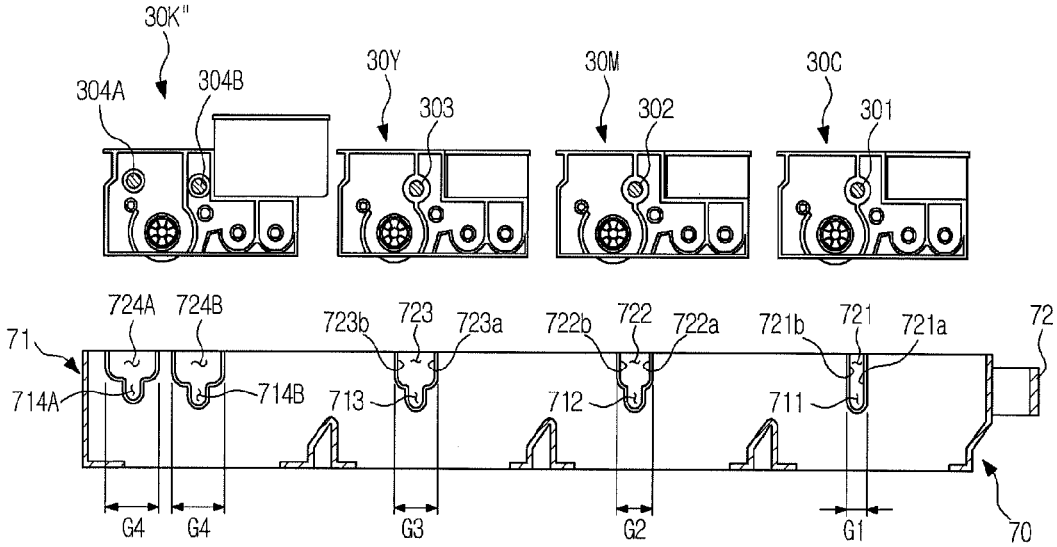
FIG. 10 is a schematic view illustrating developing units and a developing tray, which are configured in accordance with an embodiment.
Figure 11:
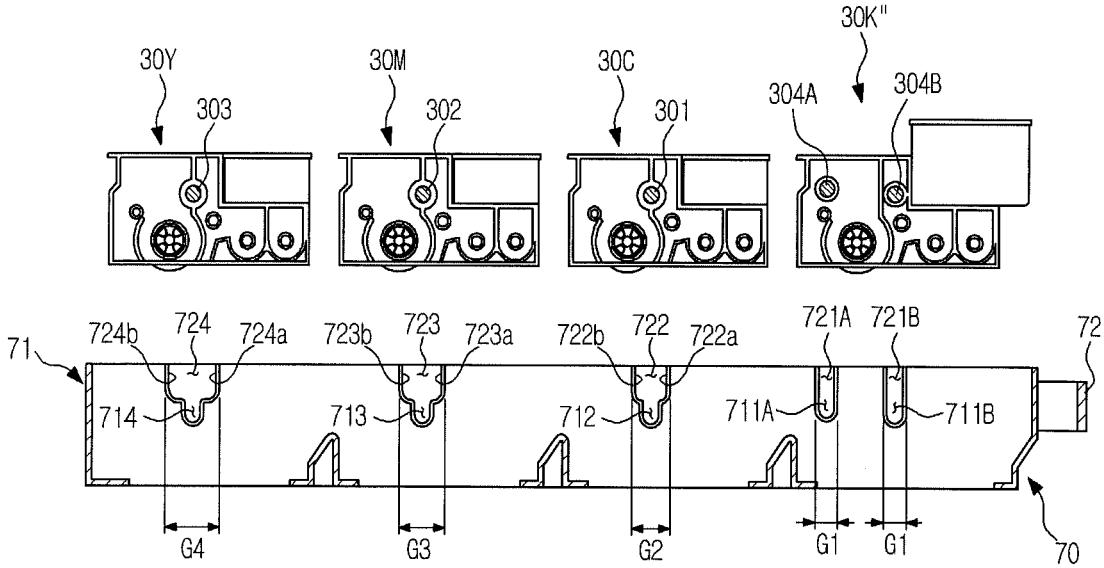
FIG. 11 is a schematic view illustrating developing units and a developing tray, which are configured in accordance with an embodiment.

FIGS. 8 to 11 illustrate embodiments in which a developing unit 30K', which contains a black developing agent, has a larger size than other developing units 30C, 30M, and 30Y. FIGS. 8 and 10 illustrate the case in which the developing unit 30K', which contains a black developing agent, is mounted at the side of the second end of the tray section 71. FIGS. 9 and 11 illustrate the case in which the developing unit 30K', which contains a black developing agent, is mounted at the side of the first end of the tray section 71.

Since the developing unit 30K', which has a larger size than the remaining developing units 30C, 30M, and 30Y, is heavier than the developing units 30C, 30M, and 30Y, the guide protrusion of the developing unit 30K', namely, a guide protrusion 304', is formed to have a larger size than the guide protrusions 301, 302 and 303 of the developing units 30C, 30M, and 30Y, as shown in FIG. 8 or 9. In order to correspond to the larger guide protrusion 304', the support disposed at the side of the first end of the tray section 71, namely, a support 711' (FIG. 9), or the support disposed at the side of the second end of the tray section 71, namely, a support 714' (FIG. 8), has a larger size than other supports.

Alternatively, since the developing unit 30K', which has a larger size than the remaining developing units 30C, 30M, and 30Y, is heavier than the developing units 30C, 30M, and 30Y, a pair of guide protrusions 304A and 304B may be formed at the larger developing unit 30K', as shown in FIG. 10 or 11. In order to correspond to the guide protrusions 304A and 304B, the support disposed at the side of the first end of the tray section 71 may include a pair of supports 711A and 711B (FIG. 11), or the support disposed at the side of the second end of the tray section 71 may include a pair of supports 714A and 714B (FIG. 10).

Although the widths of the guides 721, 722, 723 and 724 are gradually increased in a direction from the first end of the tray section 71 to the second end of the tray section 71 in above-described embodiments, embodiments are not limited thereto. There may be various modified embodiments in which the guide disposed nearest the second end of the tray section 71 has a larger width than the remaining guides, or the two guides disposed adjacent the second end of the tray section 71 have a larger width than the remaining two guides disposed adjacent the first end of the tray section 71.

As apparent from the above description, the widths of the guides are gradually increased in a direction from the first end of the tray section to the second end of the tray section. Accordingly, it may be possible to easily mount a desired one or ones of the developing units at the side of the second end of the tray section.

Although a few embodiments have been shown and described, it would be appreciated by those skilled in the art that changes may be made in these embodiments without departing from the principles and spirit of the present disclosure, the scope of which is defined in the claims and their equivalents.

What is claimed is:

1. An image forming apparatus comprising:

a body provided with an opening at one side thereof;

a developing tray movably installed into the opening; and a plurality of developing units mounted to the developing tray, wherein each of the developing units comprises guide protrusions provided at opposite sides of the developing unit, respectively, to guide mounting of the developing units to the developing tray, wherein the developing tray comprises a tray section, to which the developing units are mounted, a plurality of supports provided at opposite inner side surfaces of the tray section, to support the guide protrusions, and a plurality of guides each adapted to guide a corresponding one of the guide protrusions to a corresponding one of the supports, wherein the tray section comprises a first end protruded from the body through the opening, and a second end provided opposite to the first end such that the second end extends into an interior of the body, and wherein each guide has a different width and the widths of the guides increase in a direction from the first end of the tray section to the second end of the tray section, respectively.

2. The image forming apparatus according to claim 1, wherein the guide, which is disposed at a side of the first end of the tray section, has a width equal to a width of the corresponding support.

3. The image forming apparatus according to claim 1, wherein each of the guides comprises a first guide surface and a second guide surface, which face each other while being spaced apart from each other in the direction from the first end of the tray section to the second end of the tray section.

4. The image forming apparatus according to claim 3, wherein each of the first and second guide surfaces comprises a curved portion extending from an upper end of the corresponding support in the form of a curved line, and a straight portion upwardly extending from the curved portion such that the straight portions of the first and second guide surfaces extend in parallel to define a gap corresponding to a width of the guide therebetween.

5. The image forming apparatus according to claim 4, wherein the straight portion gaps of the guides are gradually increased in the direction from the first end of the tray section to the second end of the tray section.

6. The image forming apparatus according to claim 3, wherein:

the first guide surface upwardly inclines and extends toward the first end; and the second guide surface upwardly inclines and extends toward the second end.

7. The image forming apparatus according to claim 6, wherein:

angles formed by first guide surfaces of the guides with respect to a horizontal plane are gradually decreased in the direction from the first end of the tray section to the second end of the tray section; and angles formed by second guide surfaces of the guides with respect to the horizontal plane are gradually decreased in the direction from the first end of the tray section to the second end of the tray section.

8. The image forming apparatus according to claim 3, wherein:

the first guide surface upwardly inclined and extending toward the first end of the tray section; and the second guide surface extends in a vertical direction.

9. The image forming apparatus according to claim 8, wherein angles formed by the first guide surfaces of the guides with respect to a horizontal plane are gradually decreased in the direction from the first end of the tray section to the second end of the tray section.

10. The image forming apparatus according to claim 3, wherein heights of upper ends of the first guide surfaces in the guides are gradually decreased in the direction from the first end of the tray section to the second end of the tray section.

11. The image forming apparatus according to claim 10, wherein:

the first guide surface upwardly inclines and extends toward the first end of the tray section; and the second guide surface upwardly extends in the form of a straight line.

12. The image forming apparatus according to claim 11, wherein angles formed by the first guide surfaces of the guides with respect to a horizontal plane are gradually decreased in the direction from the first end of the tray section to the second end of the tray section.

13. The image forming apparatus according to claim 1, wherein:

one of the plurality of developing units is a developing unit containing a black developing agent; and the developing unit containing the black developing agent is mounted adjacent to one of the first and second ends of the tray section.

14. The image forming apparatus according to claim 13, wherein:

the developing unit containing the black developing agent comprises a guide protrusion having a larger diameter than the protrusions of the remaining developing units; and one of the plurality of supports, which supports the guide protrusion of the developing unit containing the black developing agent, has a larger width than the remaining supports such that the width corresponds to the diameter of the guide protrusion of the developing unit containing the black developing agent.

15. The image forming apparatus according to claim 13, wherein:

the developing unit containing the black developing agent comprises a pair of guide protrusions;

one of the plurality of supports, which supports the guide protrusion of the developing unit containing the black developing agent, comprises a pair of supports to support the pair of guide protrusions; and one of the plurality of guides, which guides the guide protrusion of the developing unit containing the black developing agent, comprises a pair of guides to guide the pair of guide protrusions to the pair of supports.

16. An image forming apparatus comprising:

a body provided with an opening at one side thereof;

a developing tray movably installed into the opening; and a plurality of developing units mounted to the developing tray, wherein each of the developing units comprises guide protrusions provided at opposite sides of each developing unit, respectively, to guide mounting of the developing unit to the developing tray, wherein the developing tray comprises a tray section, to which the developing units are mounted, a plurality of supports provided at opposite inner side surfaces of the tray section, to support associated ones of the guide protrusions, and a plurality of guides each adapted to guide a corresponding one of the plural guide protrusions to a corresponding one of the plural supports, wherein the tray section comprises a first end protruded from the body through the opening, and a second end provided opposite to the first end such that the second end extends into an interior of the body, and wherein one of the guides, which is disposed nearest the second end of the tray section, has a larger width than the remaining guides.

17. An image forming apparatus comprising:

a body provided with an opening at one side thereof;

a developing tray movably installed into the opening; and a plurality of developing units mounted to the developing tray, wherein each of the developing units comprises guide protrusions provided at opposite sides of each developing unit, respectively, to guide mounting of the developing units to the developing tray, wherein the developing tray comprises a tray section, to which the developing units are mounted, a plurality of supports provided at opposite inner side surfaces of the tray section, to support associated ones of the guide protrusions, and a plurality of guides each adapted to guide a corresponding one of the plurality of guide protrusions to a corresponding one of the plurality of supports, wherein the tray section comprises a first end protruded from the body through the opening, and a second end provided opposite to the first end such that the second end extends into an interior of the body, and wherein at least one of the plurality of guides, which is disposed adjacent the second end of the tray section, has a larger width than at least one of the remaining guides.

18. An image forming apparatus comprising:

a body provided with an opening at one side thereof;

a developing tray movably installed into the opening; and a plurality of developing units mounted to the developing tray, wherein each of the developing units comprises guide protrusions provided at opposite sides of the developing unit, respectively, to guide mounting of the developing units to the developing tray, wherein the developing tray comprises a tray section, to which the developing units are mounted, a plurality of supports provided at opposite inner side surfaces of the tray section, to support the guide protrusions, and a plurality of guides each adapted to guide a corresponding one of the guide protrusions to a corresponding one of the supports, wherein the tray section comprises a first end protruded from the body through the opening, and a second end provided opposite to the first end such that the second end extends into an interior of the body, wherein each guide has a first guide surface forming a guide angle with respect to a horizontal plane, and each formed guide angle is different from the other formed angles, and wherein each guide angle decreases in a direction from the first end of the tray section to the second end of the tray section.

* * * * *